US012022964B1

(12) United States Patent
Michalko et al.

(10) Patent No.: US 12,022,964 B1
(45) Date of Patent: Jul. 2, 2024

(54) HEATED DISPLAY CABINET

(71) Applicant: CARTER-HOFFMANN LLC, Mundelein, IL (US)

(72) Inventors: Kelly Michalko, Menominee, MI (US); Gwen Bialas, Mundelein, IL (US); Gabriel Palmisciano, Mundelein, IL (US)

(73) Assignee: CARTER-HOFFMANN LLC, Mundelein, IL (US)

( * ) Notice: Subject to any disclaimer, the term of this patent is extended or adjusted under 35 U.S.C. 154(b) by 0 days.

(21) Appl. No.: 18/203,752

(22) Filed: May 31, 2023

Related U.S. Application Data

(60) Provisional application No. 63/442,145, filed on Jan. 31, 2023.

(51) Int. Cl.
*A47F 3/00* (2006.01)
*A47F 3/04* (2006.01)

(52) U.S. Cl.
CPC ..... *A47F 3/001* (2013.01); *A47F 3/0443* (2013.01)

(58) Field of Classification Search
CPC ..... A47F 3/001; A47F 3/0443
See application file for complete search history.

(56) References Cited

U.S. PATENT DOCUMENTS 3,304,740 A * 2/1967 Balk ..... A47F 3/0447 62/275
4,002,886 A 1/1977 Sundelin
4,359,947 A * 11/1982 Marschak ..... A47B 57/04 211/186
4,888,709 A 12/1989 Revesz et al.
5,132,520 A * 7/1992 Blanton ..... A47F 3/001 219/400
5,715,622 A 2/1998 Giordano, Jr.
6,089,036 A * 7/2000 Carlson ..... A47F 3/0447 62/256
6,619,814 B1 9/2003 Hamada et al.
7,119,759 B2 10/2006 Zehner et al.
7,205,508 B2 4/2007 Sakanoue et al.
(Continued)

FOREIGN PATENT DOCUMENTS

EP 2916692 11/2021
GB 2509207 11/2014
(Continued)

OTHER PUBLICATIONS

Flexeserve Zone, Brochure: "Accessories Imperial, true hot-holding, flexible merchandising," Accessed on the Internet at: www.flexeserve.com/wp-content/uploads/2021/12/FIexeserve-Zone-Accessories-IMPERIAL-R4-NOV-21.pdf (Nov. 15, 2021).

*Primary Examiner* — Matthew W Ing
(74) *Attorney, Agent, or Firm* — Barnes & Thornburg LLP

(57) ABSTRACT

A cabinet to hold and display a plurality of food items is provided. The cabinet includes a plurality of shelves that each include holding volumes that are accessible via an open front of the cabinet. The cabinet establishes a separate and dedicated air curtain across the opening into each holding volume and the temperature of the air forming each holding volume is separately controlled. Each shelf includes a digital display that can be controlled to display various parameters of the contents of the specific shelves or other material.

25 Claims, 11 Drawing Sheets

(56) References Cited

U.S. PATENT DOCUMENTS

| | | | |
|---|---|---|---|
| 7,614,761 | B2 | 11/2009 | Tanaka |
| 7,700,894 | B2 | 4/2010 | Wuella |
| 7,726,831 | B2 | 6/2010 | Shibusawa et al. |
| 7,762,636 | B2 | 7/2010 | Vesser et al. |
| 7,798,652 | B2 | 9/2010 | Ikeda et al. |
| 7,824,057 | B2 | 11/2010 | Shibusawa et al. |
| 7,829,823 | B2 | 11/2010 | Nuttall et al. |
| 7,832,874 | B2 | 11/2010 | Ikeda et al. |
| 7,845,818 | B2 | 12/2010 | Shibusawa et al. |
| 7,857,473 | B2 | 12/2010 | Shibusawa et al. |
| 7,918,516 | B2 | 4/2011 | Decker et al. |
| 7,954,958 | B2 | 6/2011 | Ikeda et al. |
| 7,954,959 | B2 | 6/2011 | Ikeda et al. |
| 7,971,943 | B2 | 7/2011 | Quella |
| 7,997,734 | B2 | 8/2011 | Mochizuki et al. |
| 8,009,348 | B2 | 8/2011 | Zehner et al. |
| 8,047,657 | B2 | 11/2011 | Ikeda et al. |
| 8,136,956 | B2 | 3/2012 | Oketani et al. |
| 8,167,436 | B2 | 5/2012 | Ikeda et al. |
| 8,362,402 | B2 | 1/2013 | Hansen et al. |
| 8,474,781 | B2 | 7/2013 | Deguglimo et al. |
| 8,729,429 | B2 | 5/2014 | Nuttall et al. |
| 8,737,799 | B2 | 5/2014 | Asami |
| 9,251,724 | B2 | 2/2016 | Hottmann et al. |
| 9,343,001 | B2 | 5/2016 | Asami |
| 9,364,101 | B1 | 6/2016 | Anderson |
| 9,462,897 | B2 | 10/2016 | Nuttall et al. |
| 9,565,954 | B2 | 2/2017 | Nuttall |
| 9,754,515 | B2 | 9/2017 | Nicolis |
| 9,774,134 | B2 | 9/2017 | Bonner et al. |
| 10,339,579 | B2 | 7/2019 | Bonner et al. |
| 10,453,362 | B2 | 10/2019 | Bottine |
| 10,580,052 | B2 | 3/2020 | Bonner et al. |
| 10,679,583 | B2 | 6/2020 | Rössl |
| 10,719,861 | B2 | 7/2020 | Bonner et al. |
| 10,755,669 | B2 | 8/2020 | Rössl |
| 10,825,417 | B2 | 11/2020 | El-rukby et al. |
| 10,841,981 | B1 | 11/2020 | Kestner et al. |
| 10,852,002 | B1 | 12/2020 | Kestner et al. |
| 10,909,595 | B2 | 2/2021 | Bonner et al. |
| 11,219,320 | B2 | 1/2022 | Schumacher et al. |
| 11,455,912 | B2 | 9/2022 | Schumacher et al. |
| 2007/0046560 | A1 | 3/2007 | Neugebauer et al. |
| 2008/0195490 | A1 | 8/2008 | Hostetler et al. |
| 2008/0195491 | A1 | 8/2008 | Hostetler et al. |
| 2010/0253185 | A1 | 10/2010 | Kopparapu |
| 2011/0114618 | A1 | 5/2011 | Chung et al. |
| 2011/0261073 | A1 | 10/2011 | Mochizuki et al. |
| 2013/0226742 | A1* | 8/2013 | Johnson ..... G06Q 30/02 705/27.1 |
| 2014/0257946 | A1 | 9/2014 | High |
| 2015/0068821 | A1 | 3/2015 | Dillon et al. |
| 2015/0153217 | A1 | 6/2015 | Dillon et al. |
| 2015/0230631 | A1* | 8/2015 | Nuttall ..... A47F 3/0439 312/236 |
| 2016/0235218 | A1 | 8/2016 | Nuttall |
| 2016/0242571 | A1 | 8/2016 | Anderson et al. |
| 2017/0169799 | A1 | 6/2017 | Kim |
| 2020/0286135 | A1 | 9/2020 | Matayoshi |
| 2021/0398506 | A1 | 12/2021 | Rössl et al. |
| 2022/0084442 | A1 | 3/2022 | Oosthoek et al. |
| 2022/0125220 | A1 | 4/2022 | Schumacher et al. |
| 2022/0245368 | A1 | 8/2022 | Rössl |
| 2022/0374185 | A1 | 11/2022 | Oosthoek |

FOREIGN PATENT DOCUMENTS

| | | | |
|---|---|---|---|
| KR | 20140058085 | A * | 5/2014 |
| WO | 2010/046405 | | 4/2010 |
| WO | 2014/072693 | | 5/2014 |
| WO | 2014/144631 | | 6/2015 |
| WO | 2016/150430 | | 9/2016 |
| WO | 2016/187001 | | 11/2016 |
| WO | 2021/110974 | | 6/2021 |
| WO | 2021/129932 | | 7/2021 |
| WO | 2021/129933 | | 7/2021 |
| WO | 2021/187979 | | 9/2021 |
| WO | 2023/223029 | | 11/2023 |

* cited by examiner

HEATED DISPLAY CABINET

CROSS-REFERENCE TO RELATED APPLICATIONS

This application claims priority from U.S. Provisional Application No. 63/442,145, filed Jan. 31, 2023, the entirety of which is fully hereby incorporated by reference herein.

BACKGROUND

The subject disclosure relates holding cabinets and specifically holding cabinets that are provided to hold food items for customer access and purchase.

BRIEF SUMMARY

A first representative embodiment of the disclosure is provided. The embodiment includes a cabinet. The cabinet includes a housing with a top wall, right and left side walls, a lower wall and a rear wall that are collectively arranged to define an internal volume therein, wherein the housing includes an open front to allow access into the internal volume. A plurality of shelves extend within the internal volume, wherein each of the plurality of shelves have a storage volume disposed above the respective shelf, wherein each storage volume is a part of the internal volume, wherein each of the plurality of shelves comprises a conduction heater disposed on the respective shelf that adds heat to a top surface of the respective shelf. Each of the plurality of storage volumes is partially enclosed by a roof within the internal volume and above the respective storage volume, wherein the roof includes an air flow path therethrough and a plurality of apertures at an end of the roof proximate to the open front, wherein the plurality of apertures direct air flowing from the air flow path into the storage volume below the roof in an air flow direction that leaves the plurality of apertures in a substantially a downward direction. A heating assembly is provided in conjunction with each shelf and storage volume, wherein each heating assembly comprises a fan, a heating element, and at least one sensor, wherein the at least one sensor monitors a temperature of air flowing through the roof above the respective storage volume. A is provided and is configured to control operation of the respective fan, the respective heat element, and the respective heater disposed with the shelf of the plurality of shelves associated with the respective storage volume, wherein the controller selectively operates the respective conduction heater, the respective heating element, and the respective fan to control a sensed temperature of air that flows through the air flow path above the respective storage volume.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

DETAILED DESCRIPTION OF THE PREFERRED EMBODIMENTS

Figure 1:
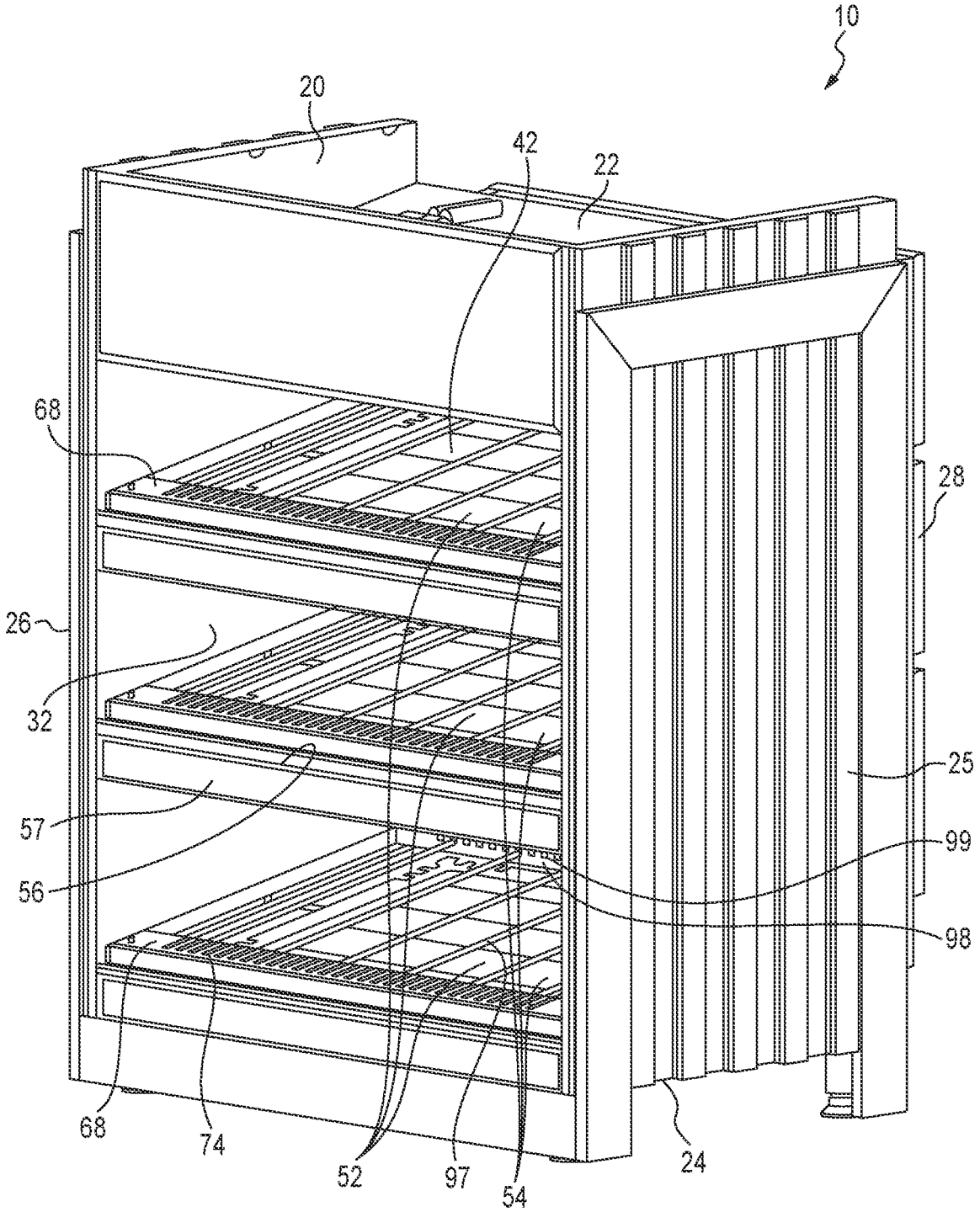
FIG. 1 is a perspective view of a cabinet with a plurality of shelves to hold items, such as food items.
Figure 2:
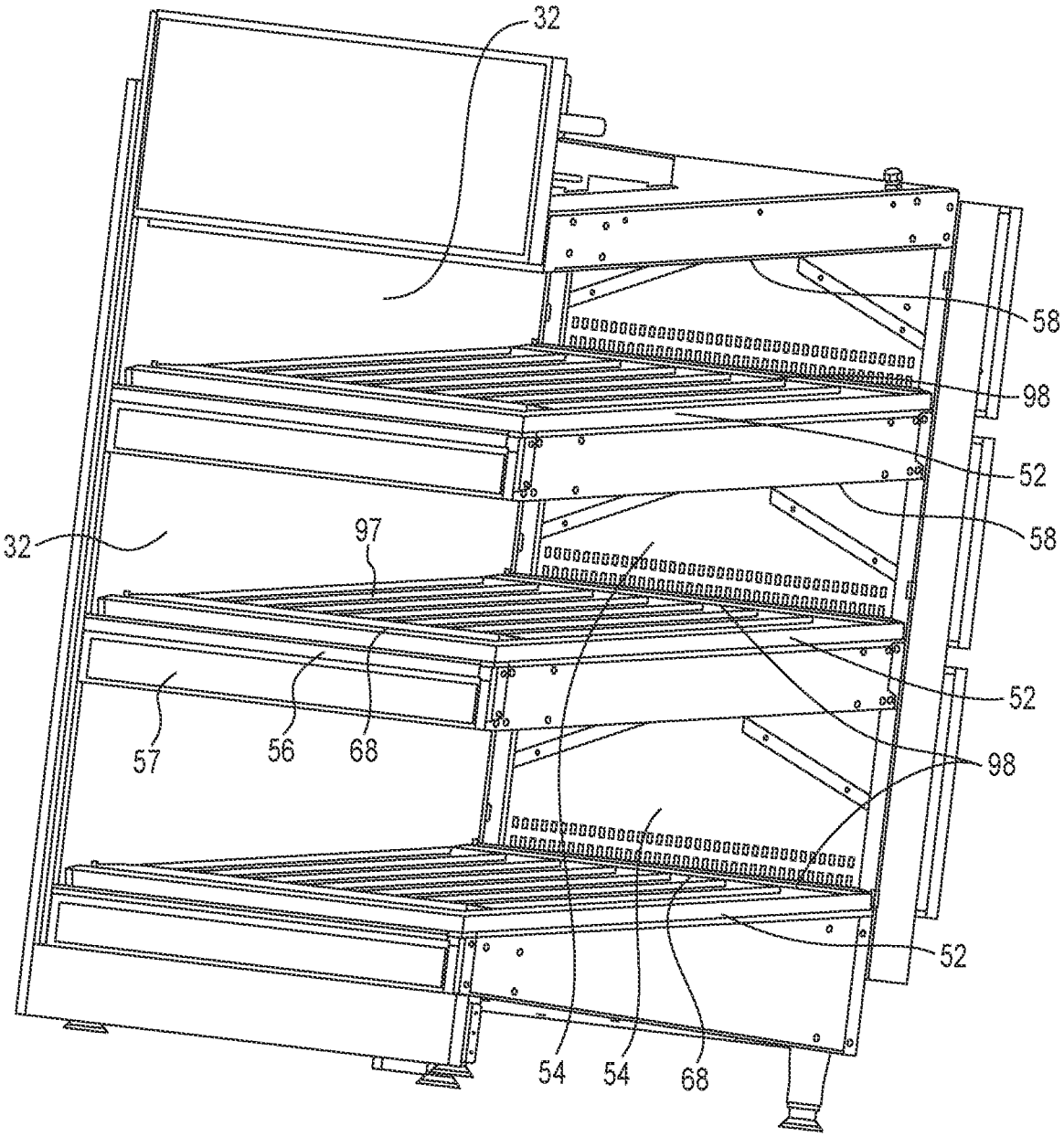
FIG. 2 is another perspective view of the cabinet of FIG. 1 with some of the elements of the housing removed to better see the shelves.
Figure 3:
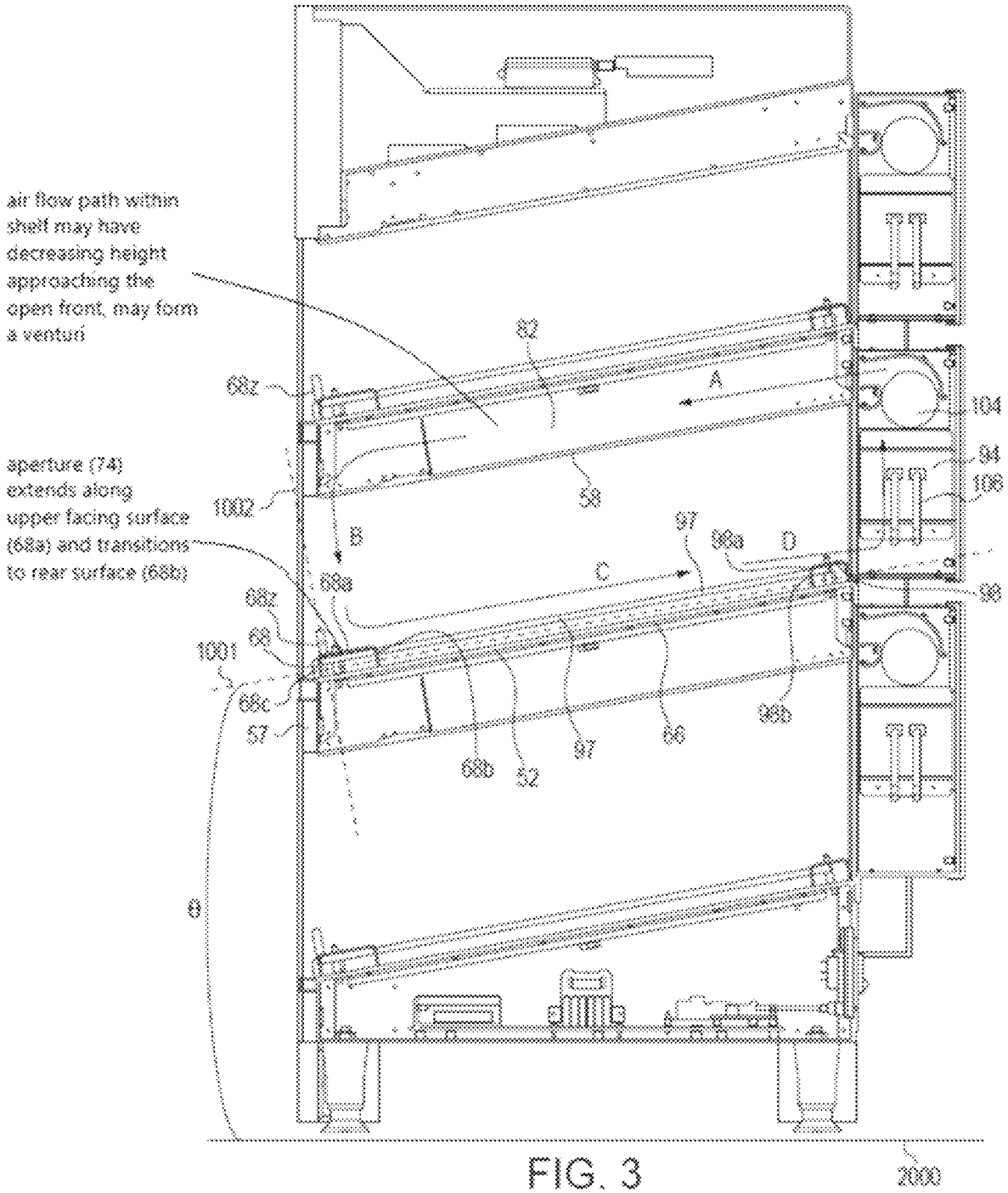
FIG. 3 is a right side cross-sectional view of the cabinet of FIG. 1 that depicts schematically the air flow path through one of the shelves and associate air movement structure associated with the shelf.

Turning now to FIGS. 1-6, a heated display cabinet 10 is provided. The cabinet 10 may be configured to supporting and displaying food items, such as prepackaged food or drink items, locally prepared food items or drinks, or the like. The cabinet may be configured for supporting non-food items desirable for individual sale, which may be maintained for the point of sale in a heated or cooled environment. While the cabinet 10 may be configured to supporting and displaying various foods, drinks, and non-edible items, for the sake of brevity the term "food item" used henceforth in this specification shall include each of food items, beverages, or non-edible items unless the specifically referring to one specific type of item below.

The cabinet 10 is configured to store a plurality of food items in an organized manner, such as in multiple rows that are formed upon each shelf 52, one or more shelves 52 provided. The cabinet 10 may include a heating system or a cooling system, or in some embodiments, both a heating and a cooling system. In these embodiments, some of the plurality of shelves may be configured with a heating system, while others of the plurality of shelves may be configured with a cooling system.

In some embodiments, the cabinet 10 includes a plurality of shelves 52, such as three, four, or five shelves, that each have the same size and orientation and each extend within the internal volume 32 of the housing. In some embodiments, each of the plurality of shelves 52 may extend in the same orientation within the housing such that the shelves are each parallel to each other. In some embodiments, each shelf 52 may extend along or parallel to a line 1001 that is at an acute angle (Θ) to the surface 2000 that housing rests upon. In these embodiments, the acute angle Θ may be aligned such that a front portion of each shelf (proximate to the open front 31 of the cabinet 10) is at a lower position than the remainder of the shelf, such that the force of gravity acting upon the food items within the shelf tend to urge the food products toward the front portion of the shelf (assuming that the mass of the food item allows the food item to slide upon the top surface of the shelf 52 due to the force of gravity). In some embodiments, the acute angle Θ may be about 20, or about 25, or about 30 degrees. In some embodiments, the acute angle may be within a range of about 10 degrees to about 30 degrees, inclusive of all angles within this range. The term "about" is defined to include the recited term plus or minus 10% of the value of the recited term.

The shelves 52 may each extend through the inner volume 32 of the housing from the rear wall 28 (either directly from such that each shelf 52 is directly in contact with or from a position that is adjacent from the rear wall 28) and to a position where a front end portion 52*a* is proximate to the opening into the internal volume 32 of the housing. Each shelf may include a top surface 53 that is a flat surface. Each shelf may extend across the entire width of the housing, and specifically the inner volume 32 of the housing 20, while in other embodiments, each shelf may extend only a portion of the width of the housing and be spaced from the right and left side walls 25, 26 of the housing 20.

The shelves 52 define a storage volume 54 that is within the inner volume 32 of the housing, and specifically within the space above the shelf 52 and below a roof 58 that is spaced above the shelf and faces the shelf 52. The storage volume 52 is the volume above the shelf 52 that the food products 3010 are received and arranged. In some embodiments the roof 58 is parallel with the shelf 52 that is positioned directly below the roof 58.

One, some, or all of the shelves 52 include a stand-off 68 that is disposed at or proximate to a forward portion 52*a* of the shelf 52. The stand-off 68 is a portion that is either formed monolithically with the shelf or is attached to the shelf and extends upwardly above the upper surface of the shelf 52. The stand-off 68 may extend across the entire width of the shelf or for one or more portions of the width. A front surface of the stand-off may be flush with a front surface 56 of the shelf 52, or the front surface of the stand-off may be positioned behind the front surface 56 of the shelf 52.

The stand-off 68 preferably includes a plurality of apertures 74 arranged thereon. In some embodiments, each embodiment is at a consistent spacing from the one or both apertures that are adjacent to the specific aperture 74 such that all apertures along the stand-off are at a consistent spacing. In other embodiments, the apertures are arranged with differing spacing between different adjacent apertures 74. The apertures 74 may be elongate and extend from a rear upper edge 69*a* (i.e. the edge between the upper facing surface 68*a* and the rear facing surface 68*b*) blindly toward the front upper edge 69*b*, but not reaching the front upper edge. In some embodiments, the aperture 74 may also extend from the rear upper edge blindly along the rear facing surface blindly. Each of the apertures may, when provided upon the rear facing surface 68*b*, extend blindly the same distance below the rear upper edge 69*a*. In some embodiments, the stand-off 68 is hollow and therefore the apertures are simply holes cut through the surface of the stand-off that form upper facing surface 68*a* and in some embodiments the rear facing surface 68*b*. In other embodiments, the stand-off 68 is a solid piece, and the apertures 74 are actually slots that are formed blindly into the stand-off that extend through the upper facing surface 68*a* and, in some embodiments, the rear facing surface 68*b*.

The use of the term "front facing surface," "upper facing surface," and "rear facing surface" are related to the principle direction that these surfaces face. For example, because, in some embodiments, the shelf 52 that the stand-off rests upon is oriented at an angle Θ with respect to the surface 2000 that the housing 20 rests upon, and because the stand-off is a rectangular (or square) structure, the front, upper, and rear facing surfaces (68*c*, 68*a*, 68*b*) do not face exactly in the front, upper (i.e. opposite from the surface 2000) and the rear direction (i.e. toward the rear wall 26 of the housing). Instead these surfaces face in a direction that is offset by the angle Θ from those directions. For example, the upper facing surface 68*a* faces at an angle that is the angle Θ away from vertical, with the front and rear facing surfaces 68*c*, 68*b* facing in a direction that is also offset at the angle Θ from the horizontal. Nevertheless, in these embodiment the upper facing surface 68*a*, for example, faces in a direction that has a vector component that is vertically upward and a second vector component that is horizontally out of the housing—but this surface is called the "upper facing surface" because it faces generally upward. The same is true with the front and rear facing surfaces 68*c*, 68*b*.

In some embodiments, a rear stand-98 is provided upon one or all of the shelves 52. The rear stand-98 may be the same height above the shelf as the respective front stand-off 68 for the same shelf, although in other embodiments, the rear stand-off 98 may be taller (distance above the upper surface of the shelf) than the front stand-off. The rear stand-off may also have a plurality of apertures 99, which may all be disposed at a consistent spacing from the adjacent apertures, or they may be at differing spacings along the stand-off. In preferred embodiments, the position of each aperture 72, 99 on the front and rear stand-offs 68, 98 are in the same position. The apertures 99 in the rear stand-off may extend blindly along a portion of the upper facing surface 98*a* to the front edge and in some embodiments blindly below the front edge along the front facing surface 98*b*. The apertures 72 and 99 are provided to removably receive a divider 97 that extends along the shelf between both front and rear stand-offs 68, 98, to serve to align food products in a front to back row upon the shelf, and to separate neighboring rows of food products upon the shelf. The dividers 97 may be tubes, or cylinders, or planar members or other shapes and orientations, such that one end of a divider is received within the front aperture 72 and the opposite end is received within the rear aperture 99, with the dividers being maintained in position by gravity.

In some embodiments the apertures (that extend through the rear facing surface 68*a* of the front stand-off and the front facing surface 98*b* of the rear stand-off 98) causes the divider 97 to be positioned above the upper surface of the shelf 52, to provide a space 96 between the shelf 52 and the divider 96. This space 96, when provided, allows for air flow therethrough which increases the possible mixing of the air through the storage volume 54 (discussed below). The space 96 also allows air to extend below the dividers, which will allow air to impinge upon the bottom portion of each food item that is disposed upon the shelf 52.

In some embodiments, each shelf 52 may include a dedicated heating volume 100 that is fixed with respect to the shelf 52. The heating volume 100 may be fixed to the rear wall 26 of the housing 20 and positioned to receive air flow the storage volume 54 above the respective shelf in a continuous manner during operation, when the forced air system, discussed herein, is operating. In some embodiments, the heating volume 100 may be fixed directly to the rear wall 26, while in other embodiments the heating volume may be fixed with respect to the shelf 52 and with respect to the rear wall 26 in such a manner that the heating volume 100 receives air from the storage volume 54.

Figure 4:
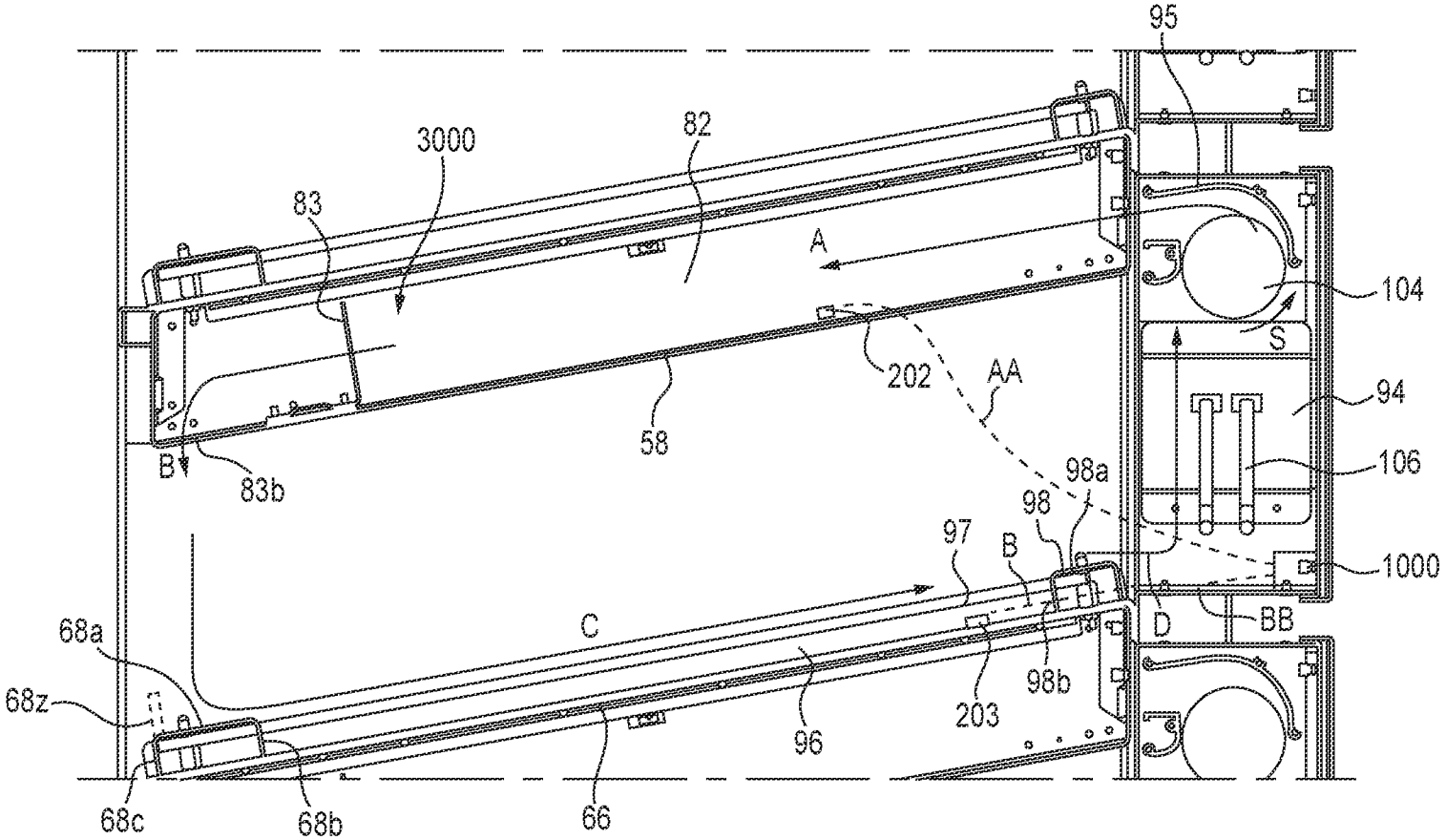
FIG. 4 is a detail view of FIG. 3 depicting one of the shelves within the cabinet.
Figure 5:
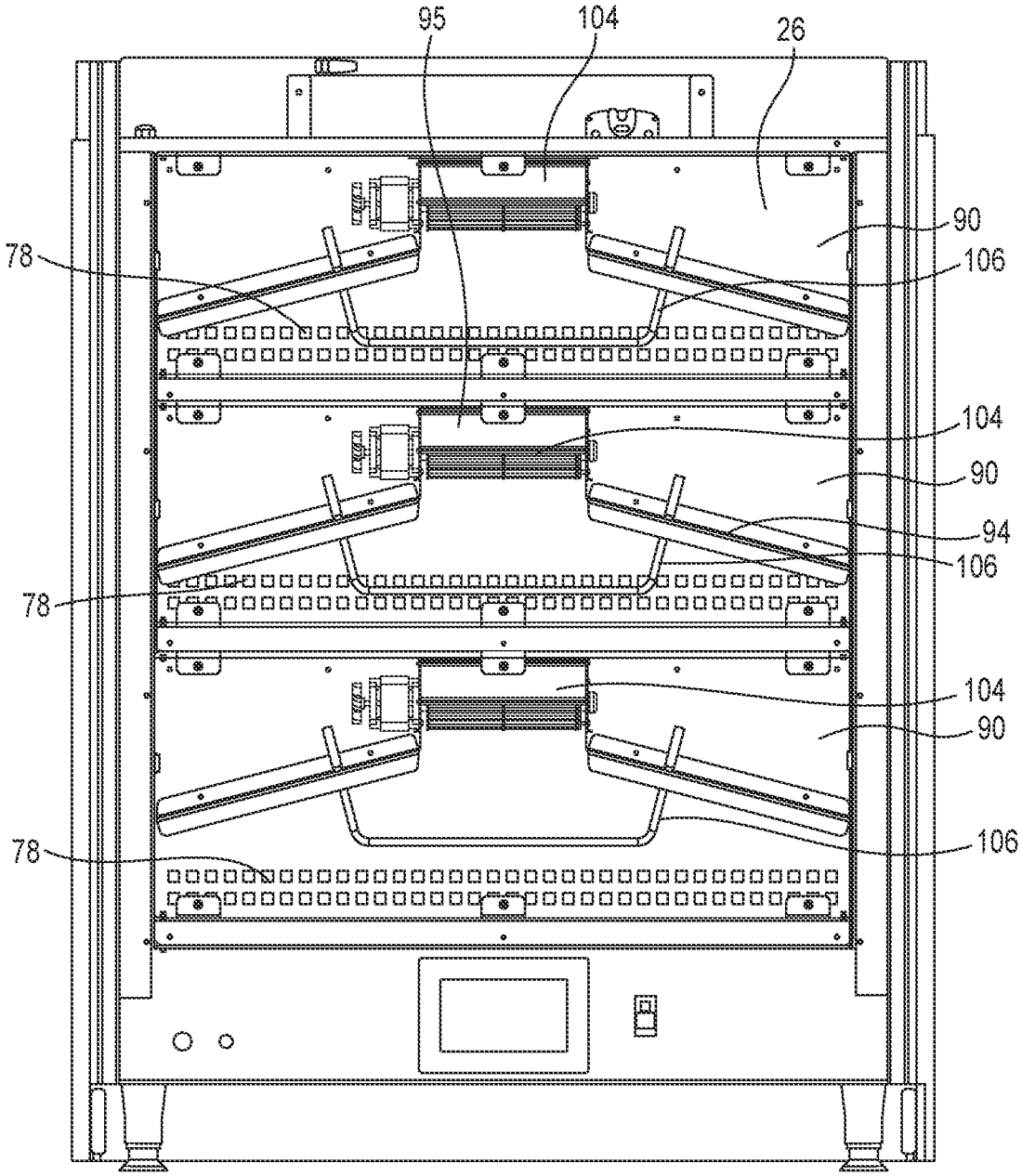
FIG. 5 is a rear view of the cabinet showing the internals of the heating volumes associated with the cabinet.
Figure 6:
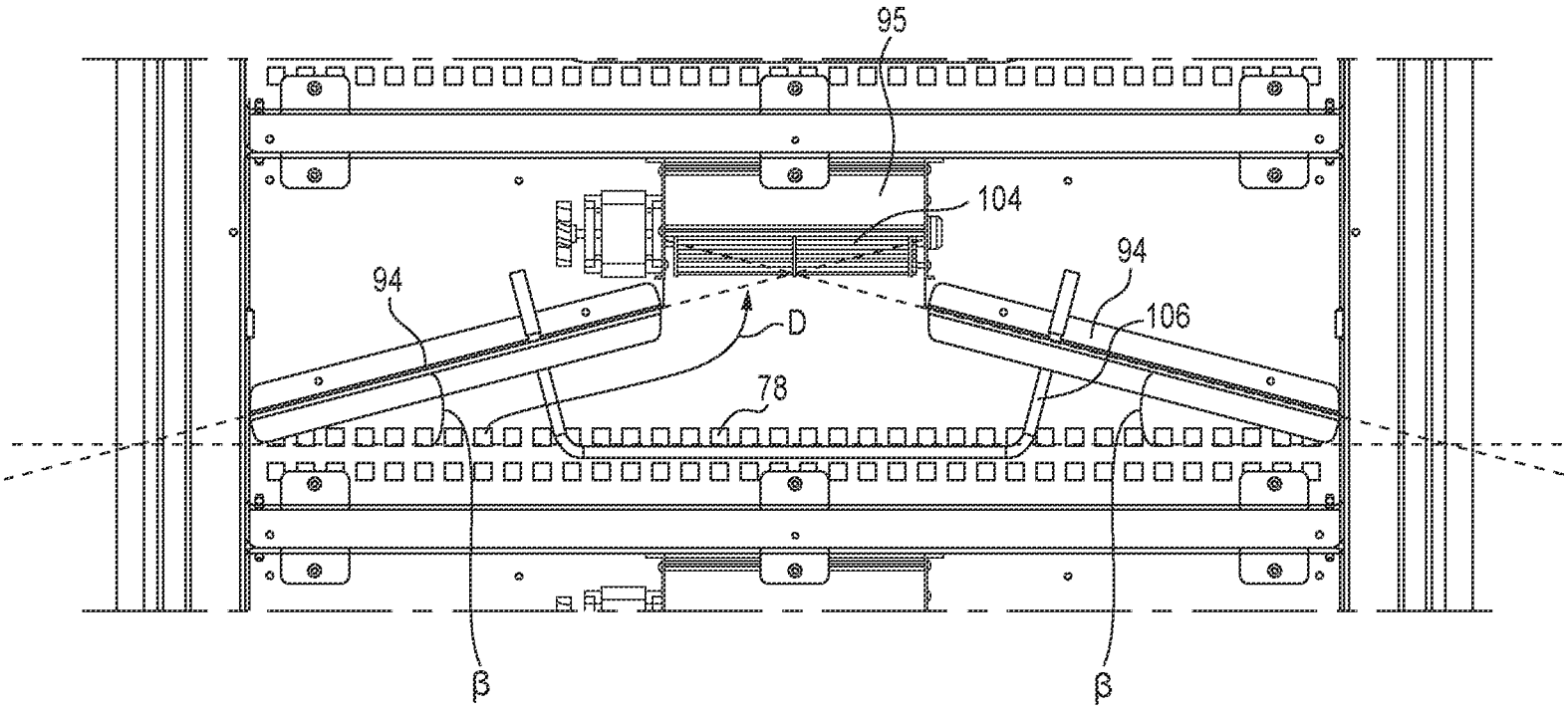
FIG. 6 is a detail view of FIG. 4 depicting one of the heating volumes.
Figure 7:
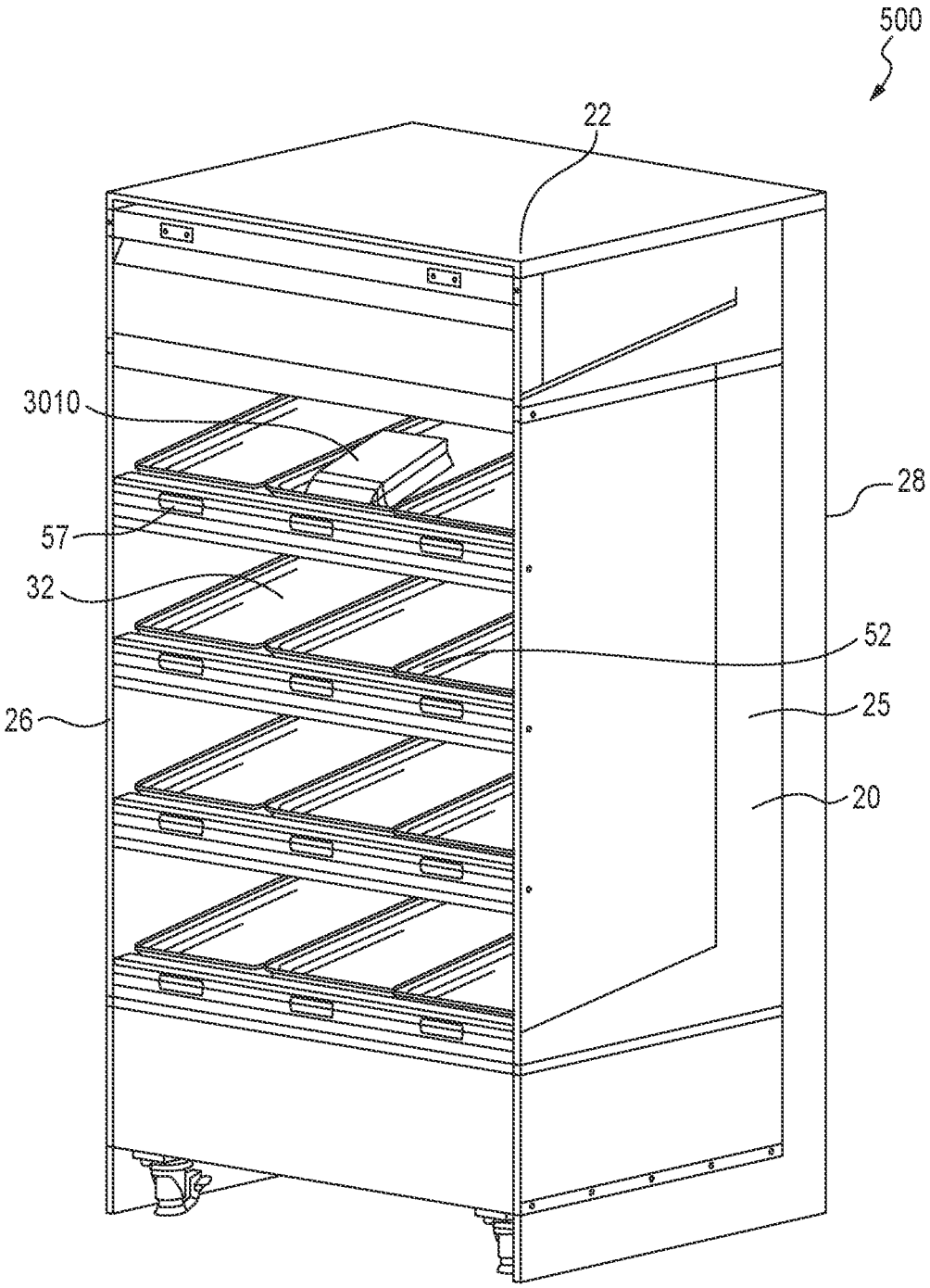
FIG. 7 is a perspective view of another cabinet with a plurality of shelves, similar to and constructed similar to the cabinet of FIG. 1 with some additional features, and depicted as receiving a food product and a plurality of trays thereon.

The heating volume 100 is best shown in FIGS. 4, 5 and 6. In some embodiments, there are provided a dedicated heating volume 100 for each shelf 52, with the components of each heating volume 100 controlled based upon sensed parameters associated with each shelf 52. In other embodiments, there may be a single heating volume 100 that interacts with each shelf, with air flow structures provided for each shelf to control the air the flows with respect to each shelf from the single heating volume.

Each heating volume 100 includes a fan 104 and a heating element 106. The heating element may be one or more resistance heaters, or it may be other types of heating elements known in the art. The heating element 106 may be positioned within the heating volume 100 to cause air that is draw into the heating volume 100 to pass by the heating element, i.e. with a single pass or in some embodiments multiple passes by the heating element if structure to baffle the flow within the heating volume 100 is provided, such that the air is heated before reaching the fan 104.

The fan is configured to draw suction from air within the heating volume 100 and discharge air into (or toward) the air flor path 84 through the roof 58 above the respective shelf 52. The air flow path 84 may be directly connected to the discharge of the fan 104, or there may be an intermediate conduit that directs air from the fan 104 to the air flow path.

The heating volume 100 may include a baffle 94 disposed therein to direct air that enters the heating volume 100 to flow toward the suction of the fan 104.

The heating volume 100 may include a second baffle 95 that is provided with the fan 104 to direct air flowing through the fan toward the desired discharge point—i.e. the second baffle 95 prevents air from leaving the fan discharge in a direction other than toward the air flow path 84.

The air flow path 3000 is best understood with reference to FIGS. 4 and 6. The air flow path 3000 extends from the discharge of the fan 104, as urged as the fan 104 rotates in the direction S (FIG. 4) and the air discharging from the fan travels from the heating volume 100 into the air flow path, as shown in arrow A (FIG. 4). Air flows through the air flow path 84 until it reaches an end thereof which is proximate to the open end of the housing 20. As air flows through the air flow path 84, in some embodiments, air flows past a sensor (202, schematic) that senses the temperature of the air flowing therepast. The sensor 202 send a signal (AA, schematic) to a controller 1000 (FIG. 4, schematic) which is discussed in detail below. In some embodiments, the air flow path 84 may include one or more baffles 83 that require the air to flow in specific directions within the air flow path or in some embodiments through apertures. The baffles 83 may be provided to adjust the pressure within the air flow path 84 to accordingly adjust the air flow rate and air pressure of the air that leaves the air flow path and flows into the heated volume 54.

Air flows from the air flow path 84 and into the heated volume through one or a plurality of apertures 83*b* that are provided at the end portion of the roof 58 and direct the air in a substantially downward direction into the heated volume 54 and toward the shelf 52 directly below the roof 58—as depicted in air flow B (FIG. 4). This air flows initially downward (in some embodiments directly downward, or in other embodiments generally downward—i.e. with a significant downward vector components but potentially also with a minor horizontal vector component—with the term substantially downward specifically including both possibilities within its scope) and the air flow direction is a function of the angle of the roof 58 and specifically the location of the apertures 83*b* within the roof 58. One of ordinary skill in the art with a thorough review of this specification and figures will understand how to position and align the holes 83*b* with respect to the roof for a desired direction of air flow with merely routine optimization.

The air that leaves through the holes 83*b* and is directly downwardly establishes an "air curtain" across the opening 32 into the housing and specifically the storage volume 54 above the shelf. The air curtain is provided to establish a barrier between the storage volume 54 and the atmosphere surrounding the outside of the housing, which may assist with maintain the temperature controlled environment within the storage volume 54 as desired. The air curtain may also prevent or minimize unwanted items—such as dust, or insects, or smells from crossing the air curtain and into the storage volume 54, and may also prevent smells from leaving the storage volume 54 through the air curtain.

The air flow B that establishes the air curtain may turn inwardly to flow generally across the surface of the shelf 52 and toward the rear wall 26 of the housing, as depicted as arrow C in FIG. 4. In some embodiments, (FIG. 3, 4) the first (front) stand-off 68 may support a fence 68*z* that extends upwardly from the stand-off 68, to which a portion of the air curtain flows past, and directs that flowing air inwardly into the storage volume. The air flowing downwardly via the air curtain is urged to turn inwardly due to the front stand-off 68 and the shelf, and due a suction that extends through the apertures 78 provided within the rear wall 26.

The air flow C flows through the storage volume 54 and across the shelf 52 and past any food items that resting upon the shelf. Air reaching the rear end of the storage volume 54 flows through the plurality of apertures 78 in the rear wall 26 (or other structure the establishes the rear boundary of the storage volume 54) and flows into the heating volume 100—as depicted as air flow D (FIG. 4, 6). When entering the heating volume 100, the air passes across or proximate to the heating element 106, thereby increasing the temperature of the air flow and is directed to the suction of the fan 104, as urged by the baffle 96 when provided. The air then cycles again as discussed above.

As discussed herein, the cyclic air flow (paths A, B, C, and D) is urged by the fan 104 and heated by the heating element 106. The controller 1000 is provided to monitor the temperature of the air flowing through the air flow path (via sensor 202) and uses conventional feedback control to control the duty cycle of the heating element 106 to maintain the temperature flowing through the air flow path either as close as possible to a desired temperature, or in some embodiments, within a temperature range. The desired temperature (or temperature range) may established by the controller with reference to a set of programmed temperatures or ranges for various different foods that might be stored within the storage volume 54 and selected by the controller 1000 with a user input of the food items that are stored within the storage volume at that time. The user may input the information to the controller either via a data entry device located directly upon the cabinet, or in other embodiments, via a remote data entry (either a remote computer or a POS system). The controller 1000 may communicate with the remote data entry device (when provided) via Wi-Fi, Bluetooth, or other non-wired communication protocols, or via a wired connection.

In some embodiments, the controller 1000 controls the speed of fan 104 rotation to control the mass flow rate of air that is moved through the system to establish the air curtain and to provide heating/cooling to the storage volume 54. In some embodiments, when an air curtain is not desired, the fan 104 can be stopped. In these circumstances the heating element 106 is typically also turned off and the conduction heater 66 is used to adjust the temperature with the storage volume 54.

In some embodiments, one, some or all of the shelves 52 may include a conduction heater 66 thereon, which when operating supplies heat to the top surface of the shelf 52 and therefore to food items that are disposed upon the shelf 52. The conduction heater 66 may form the top surface of the shelf 52 or in other embodiments it may be below the top surface of the shelf, and within the materials that form the shelf 52, both possibilities are defined herein as on the shelf. The shelf 52, below the conduction heater 66, may be insulated to prevent a significant flow of heat from the conduction heater 66 downward therefrom, either into the air flow path 82 associated with the shelf that is located in the roof below the shelf that includes the heater, or into the bottom floor of the housing for the bottom-most shelf 52. The controller 1000 may operate the conduction heater using feedback control to maintain the temperature of the air within the air flow path 84 at or close to the desires temperature, or within the established temperature range, as discussed above.

In some embodiments, a second temperature sensor 203 (FIG. 4, schematic) may be provided and sense a temperature at or proximate to the top surface of the shelf 52. The second sensor 203 sends a signal to the controller (BB—schematic) to the controller 1000 related to the sensed temperature. The controller may control the duty cycle and of the conduction heater 66, and/or may control the magnitude of heat generated by the conduction heater 66 to maintain the sensed temperature by the second sensor 203 close to a desired setpoint, or within a desired range. The controller 1000 may use temperature feedback controller to operate the conduction heater 66, either individually or in combination with the heating element 106 using temperature feedback control. One of ordinary skill that reviews and fully understands this specification would be capable of programming the controller 1000 to operate the conduction heater 66 independently, or in concert with the heating element 106 to maintain the sensed temperatures 202, 203 close to the desired temperature or within temperature bands with only routine optimization.

In some embodiments, one, some or all of the shelves 52 and related storage volumes may be cooled in addition to or in alternative to heating. In some embodiments, one, some, or all of the shelves may include one or more Peltier coolers, a chilled water system, or other air conditioning systems as are known in the art. The cooling components may be provided in the heating volume 100 (which in this circumstance provides cooling notwithstanding the name "heating volume") or within the air flow path 82. The cooling system may be operated by the controller 1000 to maintain a desired temperature that is lower than ambient, or in other embodiments, the heating and cooling systems may be operated with respect to each other as needed by the controller 1000 to maintain the sensed temperature within a desired range.

In some embodiments, one, some, or all of the shelves 52 may include a digital display 57 that is positioned upon the forward facing surface 56 of each shelf 52. The digital display 57 is operated by the controller 1000 (or in other embodiments a different controller than the controller that controls the temperature within the cabinet) in order to display various items, such as advertisements, inventories of the food items disposed upon the shelves, prices of the food items, biographic information (e.g. when fresh food, or recently cooked or prepared food is upon the shelf a "prepared on" time/date can be provided upon the display), sales or special offers associated with the food items, images of the food items (actual images, or trademarks associated with the food items), and/or other items such as news, sports scores, weather, traffic reports, and the like. The digital display may be capable of a continuously moving display or static displays.

In some embodiments, the display screen 57 may be capable of displaying one, some, or all of numbers, words, symbols, or pictures that are associated with food items that are intended to be disposed within the storage volume above the respective shelf. In some embodiments, the controller 1000 may operate in conjunction with an inventory management system, such as the POS system, to display the number of food items that are included within the storage volume. In some embodiments the display may include specific and different displays that are aligned with the various rows of food items included upon a single shelf as aligned by the dividers 97 as discussed above. In some embodiments, the housing 20 may include sensors that are disposed proximate to the opening 32 into the cabinet that can identify when food items are inserted into and removed from the shelf through the opening, and in conjunction with the controller can update the display (such as a display listing the current inventory of the number of food items within each row) as the inventory changes due to inserting or removing food items. The sensor may be an RFID sensor, a code reader (i.e. a QR or UPC code reader) or other types of sensors known in the art or developed in the future to perform the functionality of identifying food items based upon their appearance and shape or based upon code markings upon the food items.

In some embodiments, the display screen 57, and therefore the controller that operates the display screen 57 may communicate with the POS system and/or with a server (local to the establishment that includes the cabinet 10 or a remote server) such that the display can be altered local or remotely. In circumstances where the controller can communicate with a remote server, the remote server can in real time update the display—such as with updated pricing information, updated advertisements, updated news, weather, sports scores, and the like. The communication between the display screen and a remote server may allow for, for example, an entity that has multiple stores with the same cabinet (or similar cabinets) to simultaneously change the display screens for different cabinets at different facilities.

Turning now to FIGS. 7-11, a further embodiment of a cabinet 500 is provided. The cabinet 500 includes the same structure that is included within the embodiments discussed above unless specifically discussed herein, and like element numbers for the same structure in the cabinet 500 depicted herein as with the cabinet 10 are used for the sake of simplicity, and components of cabinet 500 that are not specifically discussed below are the same features as discussed with respect to cabinet 10 (even if not specifically identified in the drawings within FIGS. 7-11). The cabinet 500 includes a plurality of shelves 52, such as 4 shelves as depicted, but other numbers of shelves are possible such as three, or five shelves, that each have the same size and orientation and extend within the internal volume 32 of the housing. In some embodiments, all of the shelves 52 extend in parallel with each other. As with the embodiment below, the shelves may extend along or parallel to a line 1001 that is at an acute angle (Θ) to the surface 2000 that housing rests upon. In these embodiments, the acute angle Θ may be aligned such that a front portion of each shelf (proximate to the open front 31 of the cabinet 10) is at a lower position than the remainder of the shelf, such that the force of gravity acting upon the food items within the shelf tend to urge the food products toward the front portion of the shelf (assuming that the mass of the food item allows the food item to slide upon the top surface of the shelf 52 due to the force of gravity). In some embodiments, the acute angle Θ may be about 20, or about 25, or about 30 degrees. In some embodiments, the acute angle may be within a range of about 10 degrees to about 30 degrees, inclusive of all angles within this range. The shelves are arranged and constructed in the same manner as the shelves 52 discussed above.

Figure 10:
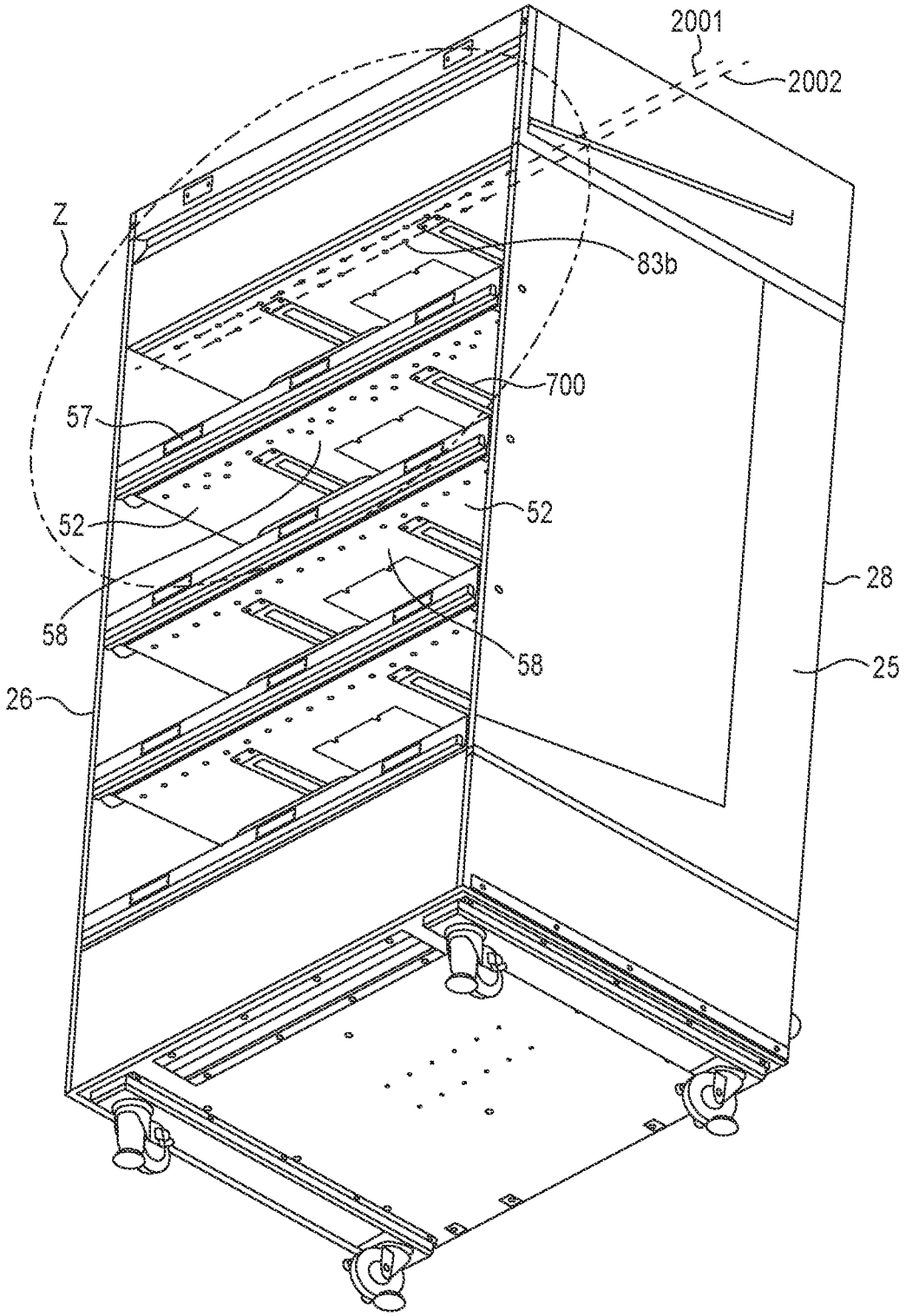
FIG. 10 is another side view of the cabinet of FIG. 7.
Figure 11:
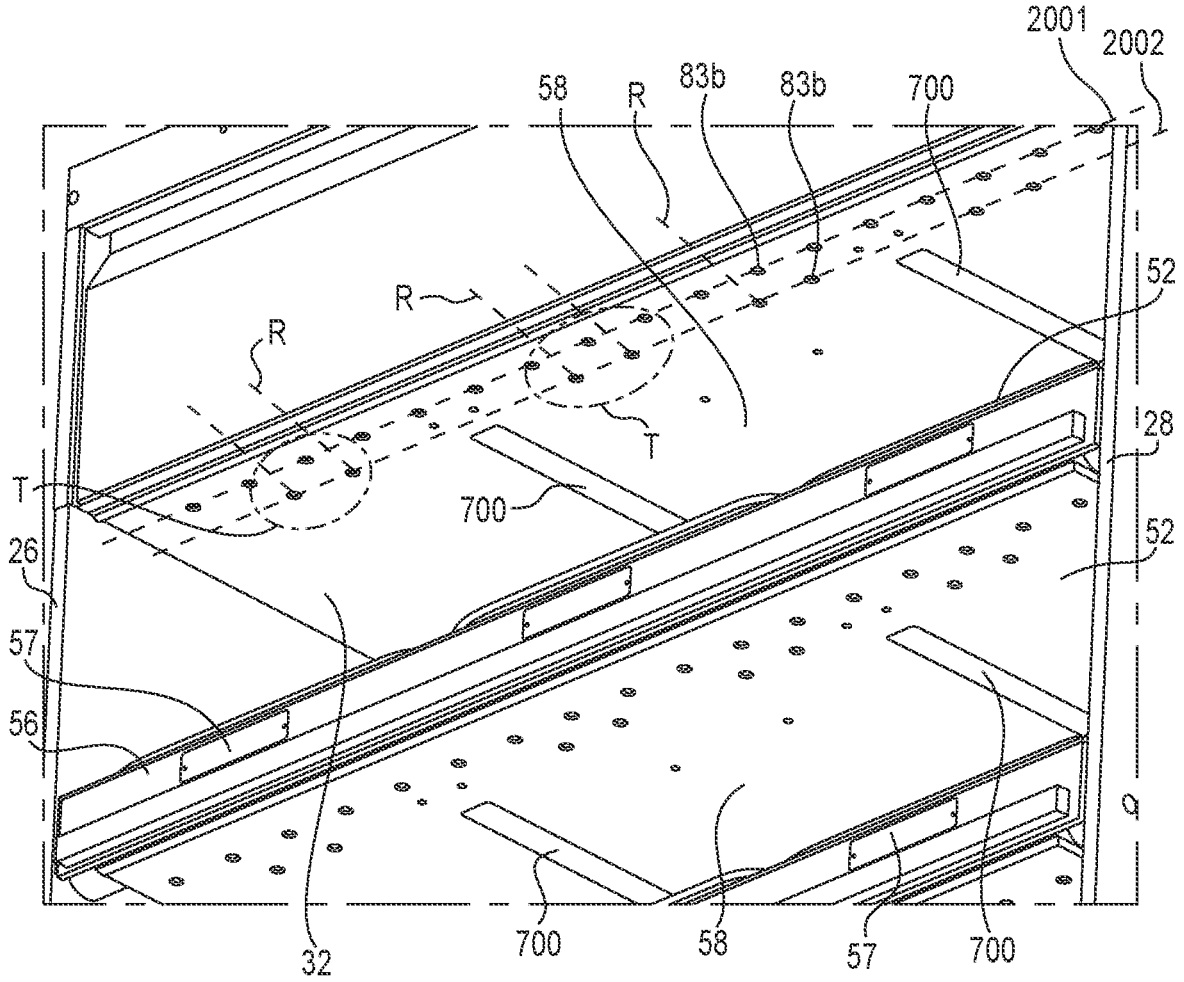
FIG. 11 is a detail view of detail Z of FIG. 10.

As depicted in FIGS. 10 and 11, the shelves 52 may each include a plurality of apertures 83*b* that are aligned proximate to a front end portion of the roof 58 to direct the air flowing though the shelf in a substantially downward direction in the heated volume 54 and toward the shelf 52 below the roof 58 (as depicted in air flow B (FIG. 4)) to establish an air curtain as discussed with the above embodiment, with the air flow in this embodiment consistent with the above embodiment as modified per the discussion herein. In some embodiments, the apertures 83*b* on the roof are positioned along a line 2001 that is parallel to a front face of the housing. In some embodiments, the apertures 83*b* are also positioned along a second line 2002 that is parallel to line 2001 and positioned slightly inboard of the line 2001 of apertures. In some embodiments, there are more apertures 83*b* in the line 2001 that is closer to the open front than the second line 2002 that is further from the open front.

In some embodiments, there may be a plurality of groups T of apertures 83*b* that extend long the second line 2002. The groups T may be equally spaced through a width of the shelf 52, while in other embodiments, and as depicted in detailed FIG. 11, the groups T may be positioned in clusters that are spaced from each other. Each of the apertures within a cluster may have a consistent spacing from each adjacent aperture within the same cluster, while outermost apertures within each cluster are spaced from adjacent apertures in differing clusters with a spacing that is larger than the spacing between adjacent apertures within the same cluster.

In some embodiments, the apertures within groups T may be two apertures 83*b* that are positioned in a location at a midpoint between two apertures within line 2001 (line R, FIG. 11), i.e. in this embodiment, the two apertures 83*b* in the group T within line 2002 are positioned with the two gaps within a set of three apertures within line 2001. In other embodiments, the groups T may have three grouped, and consistently spaced apertures 83*b* that are arranged with respect to four apertures 83*b* within the first line 2001. The apertures 83*b* in the second line 2002 may be between apertures in the first line (i.e. lines R, FIG. 11) or they may be positioned in rows with apertures 83*b* from the first line 2001. In this arrangement, the volume flow rate of air that forms the curtain is increased in local areas proximate to the groups T— which are spaced from each other along the width of the shelf. This has been found to improve the air curtain by increasing the mass-flow rate of air establishing the air curtain at several localized areas along the width of the shelf 52.

In some embodiments, the shelves 52 may each include two or more lights 700 that are positioned above the respective shelf to provide illumination to the shelf 52, and the contents upon the shelf. For the upper-most shelf, the roof above the shelf may include lights 700. The lights 700 may one or a combination of several LEDs that are controlled by the 1000. The lights 700 may be constantly on, or may be controlled via various routines.

For example, the lights 700 may illuminate, or change the brightness and/or the color of illumination and/or flash on and off repeatedly when a sensor (not show) identifies that an object passes into the housing and above the shelf 52. The lights 700 may illuminate and/or change brightness, and/or flash repeatedly based upon instructions from the controller 1000. The instructions may sent to change color, flash, change intensity at random or periodic times, or when a sensor identifies that a person is proximate to the housing. The controller 1000 may communicate with a point of sale system, or an inventory management system and provide instructions for the lights to change color, and/or intensity, or flash when it is desired to identify or promote the products within the housing, and in some embodiments upon certain shelves, or even certain positions upon certain shelves. The controller 1000 may be programmed to operate different lights 700 on different shelves, or even different lights 700 upon the same shelf differently at the same time to provide differing indications. The controller 1000 may operate the digital display 57 associated with the shelf at the same time as operating the lights 700 that shine down upon the same shelf to further promote and call attention to the housing.

One of ordinary skill in the art with a thorough review of the as-filed specification will understand how to program a controller 1000 (or operate the controller 1000 via a system in communication with the controller 1000— i.e. a local point of sale system, or in some embodiments a system that communicates with systems in various affiliated locations— i.e. a franchisor based system that can communication with point of sale systems and local controllers 1000 for systems 10 in various franchisee locations) in order to call attention to shelves 52 and the products positioned upon the shelves 52 with an intelligent and creative use of the digital display 57 and/or the lights 700 (i.e. with flashing, color changing, and or changing intensity lights 700 in conjunction with words and images upon the digital display) to provide interest and excitement to customers that are positioned near the cabinet 10.

Figure 8:
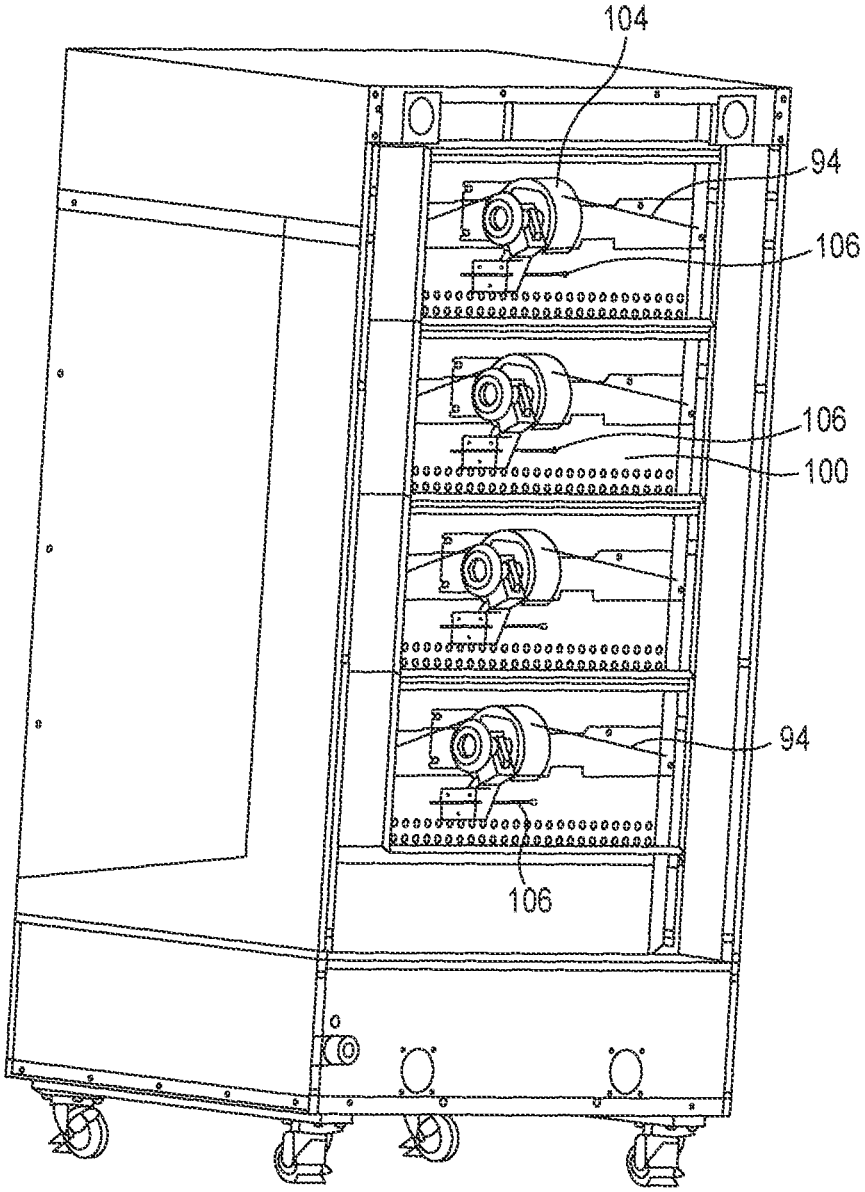
FIG. 8 is a view of the rear side of the cabinet of FIG. 7 with a back panel removed to display the heating compartments for each of the plurality of shelves.
Figure 9:
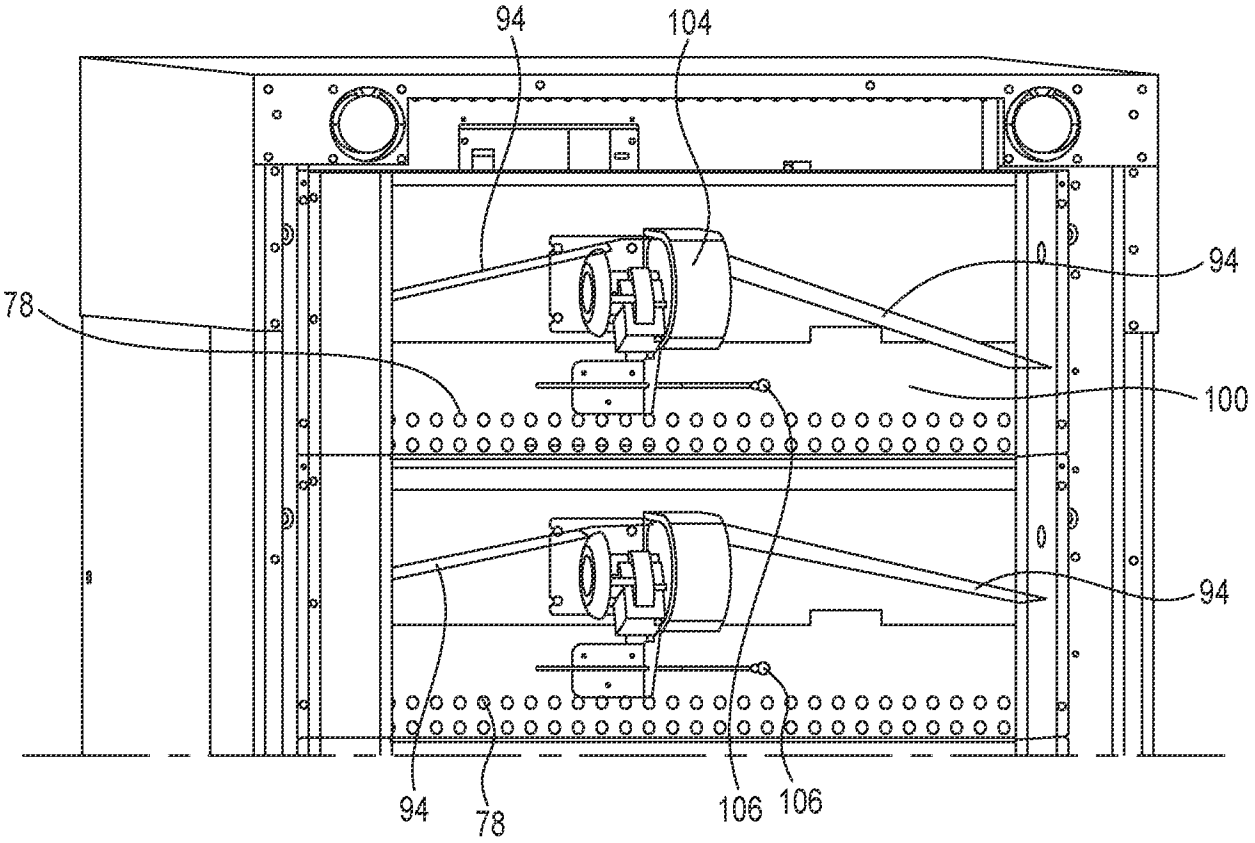
FIG. 9 is a detail view of the upper two heating compartments of the view of FIG. 8.

With reference to FIGS. 8 and 9, the fan 104 that is associated with each heating volume 100 may be a blower, such as a squirrel cage blower as depicted in FIGS. 8 and 9. The heating volume 100 may include baffles 94, as depicted in FIG. 9. The baffles urge air flowing through the apertures 78 (air flow path D— FIG. 4) past the heating element 106 and to the suction of the fan 104. The discharge of the fan 104 urges air into the air flow path 82 (A— FIG. 4) as discussed with respect to the embodiment above. As best shown in FIG. 6, the baffle 94 may extend across the width of the heating volume—which is approximately the width of the respective shelf 52 that is adjacent to the heating volume, and the baffle 94 extends across all of the plurality of apertures 78 that extend through the rear wall 26 (or other structure that separates the storage volume 54 and the heating volume 100, either directly or indirectly). The baffle 94 may include two or more segments that are positioned to direct air flowing through the apertures 78 to the suction of the fan 104. As depicted in FIG. 6, the baffle 94 may be positioned at an angle β with respect to the horizontal (i.e. the surface that the housing rests upon). The angle β may be about 10 to about 30 degrees, such as about 10, 15, 20, 25, or 30 degrees, inclusive of all angles within the range of about 10 degrees to about 30 degrees. In other embodiments, the baffle 94 may include an arcuate shape such with an increasing local angle β as the baffle gets closer to the suction of the fan 104.

The baffles 94 and the fan 104 may be arranged to expel air into the shelf 52 (arrow A— FIG. 4). In some embodiments, the width if the shelf along its length (and specifically the portion of the shelf 52 that includes air flow path A) may narrow along its length toward the front end of the shelf. This narrowing increases the pressure at the apertures 83*b*, which increases the air speed of the air flowing out of the apertures 83*b* to establish the air curtain (arrow B— FIG. 4). The shelf 52 may include internal baffles 83 that establish the air flow path within the shelf to form a nozzle or a venturi, which further increases the pressure and flow speed. In some embodiments, baffles like baffles 83 of the cabinet 10 may be provided to smooth out the flow, such as at an angle (such as 45 degrees) within a top front corner within the shelf to urge air flowing along the length of the shelf (arrow A— FIG. 4) to transition to a vertical flow (arrow B— FIG. 4) to flow though the apertures 83*b* and out of the shelf. One of ordinary skill in the art with a thorough review of this specification will understand how to use one or more baffles 83 within the shelf 52 to smooth out the flow, i.e. to maintain laminar flow, yet still design the geometry and the baffles within the shelf to increase the speed of the flow through the apertures 83 with only routine optimization.

Certain aspects of the disclosure are embodied by the following numbered paragraphs:

Numbered Paragraph 1: A cabinet comprising:

a housing with a top wall, right and left side walls, a lower wall and a rear wall that are collectively arranged to define an internal volume therein, wherein the housing includes an open front to allow access into the internal volume;

a plurality of shelves that extend within the internal volume, wherein each of the plurality of shelves have a storage volume disposed above the respective shelf, wherein each storage volume is a part of the internal volume, wherein each of the plurality of shelves comprises a conduction heater disposed on the respective shelf that adds heat to a top surface of the respective shelf;

wherein each of the plurality of storage volumes is partially enclosed by a roof within the internal volume and above the respective storage volume, wherein the roof includes an air flow path therethrough and a plurality of apertures at an end of the roof proximate to the open front, wherein the plurality of apertures direct air flowing from the air flow path into the storage volume below the roof in an air flow direction that leaves the plurality of apertures in a substantially a downward direction;

further comprising a heating assembly that is provided in conjunction with each shelf and storage volume, wherein each heating assembly comprises a fan, a heating element, and at least one sensor, wherein the at least one sensor monitors a temperature of air flowing through the roof above the respective storage volume;

further comprising a controller, the controller is configured to control operation of the respective fan, the respective heat element, and the respective heater disposed with the shelf of the plurality of shelves associated with the respective storage volume, wherein the controller selectively operates the respective conduction heater, the respective heating element, and the respective fan to control a sensed temperature of air that flows through the air flow path above the respective storage volume.

Numbered Paragraph 2: The cabinet of Numbered Paragraph 1, wherein each shelf comprises a first standoff disposed at a front portion thereof proximate to the open front.

Numbered Paragraph 3: The cabinet of Numbered Paragraph 2, wherein each first standoff comprises a plurality of apertures therein.

Numbered Paragraph 4: The cabinet of Numbered Paragraph 3, wherein each of the plurality of apertures are disposed with consistent spacing between adjacent apertures.

Numbered Paragraph 5: The cabinet of any one of Numbered Paragraphs 3 or 4, wherein each of the plurality of apertures extend along an upward facing surface of the standoff and transition to a surface that faces the rear wall of the housing.

Numbered Paragraph 6: The cabinet of any one of the preceding Numbered Paragraphs, wherein the rear wall of the housing has a plurality of sets of apertures, wherein each set of apertures of the plurality of apertures is aligned above each of the respective plurality of shelves.

Numbered Paragraph 7: The cabinet of Numbered Paragraph 6, wherein each heating assembly is disposed within a heating volume of a plurality of heating volumes, wherein each respective heating volume of the plurality of heating volumes is fixed to the rear wall proximate to the associated shelf such that each heating assembly encloses the respective heating element and fan of the respective heating assembly, wherein the set of apertures aligned above each respective shelf allows air flow into the respective heating assembly disposed proximate to the respective shelf.

Numbered Paragraph 8: The cabinet of any one of the preceding Numbered Paragraphs, wherein the heating assembly comprises angled divider disposed therein, the angled divider extends across the heating assembly above the plurality of holes and directs air entering through heating assembly through the plurality of holes to a suction of the fan.

Numbered Paragraph 9: The cabinet of either one of Numbered Paragraph 8, wherein the heating element is disposed below the angled divider such that air entering into the heating assembly passes across or proximate to the heating element before flowing into the suction of the fan.

Numbered Paragraph 10: The cabinet of Numbered Paragraphs 8 or 9, wherein the discharge of the fan directs air into the air flow path within the roof.

Numbered Paragraph 11: The cabinet of any one of the preceding Numbered Paragraphs, wherein the at least one sensor is disposed within the air flow path.

Numbered Paragraph 12: The cabinet of any one of the preceding Numbered Paragraphs, further comprising a second sensor associated with each shelf, wherein each second associated is disposed proximate to a top surface of the shelf.

Numbered Paragraph 13: The cabinet of Numbered Paragraph 5, wherein each shelf has a second standoff that is proximate to or in contact with the rear wall of the housing, wherein the second standoff comprises a plurality of apertures therein, wherein the plurality of apertures in the first standoff are arranged in the same alignment as the plurality of apertures in the second standoff.

Numbered Paragraph 14: The cabinet of Numbered Paragraph 13, wherein the housing further comprises a plurality of dividers that can extend within an aperture in the first standoff to an aperture within the second standoff.

Numbered Paragraph 15: The cabinet of Numbered Paragraph 1, wherein each shelf has a forward facing surface that extends proximate to the open front of the housing, wherein each forward facing surface supports a display screen, wherein the controller is configured to operate the display screen to include one or more of numbers, words, symbols, or pictures that are associated with items that are intended to be disposed within the storage volume above the respective shelf.

Numbered Paragraph 16: The cabinet of Numbered Paragraph 15, wherein the display screen is configured to allow for a continuously moving display.

Numbered Paragraph 17: The cabinet of Numbered Paragraph 16, the display screen is configured to display the types and amounts of items that are included within the respective storage volume, and include price and/or biographic information associated with the items that are within the storage volume.

Numbered Paragraph 18: The cabinet of any one of Numbered Paragraphs 1-17, wherein the plurality of apertures at the end of the roof are positioned along two parallel lines that are each parallel to a front face of the housing, wherein a first of the two parallel lines closest to the open front include more apertures than the apertures that form the second line further from the open front.

Numbered Paragraph 19: The cabinet of any one of Numbered Paragraphs 1-18, wherein the plurality of apertures at the end of the roof are positioned along two parallel lines that are each parallel to a front face of the housing, wherein the apertures in the first of two parallel lines are each evenly spaced across a width between the left and right sides of the housing, and the apertures in the second of the two parallel lines are established in a plurality of groups, wherein each aperture within each group are evenly spaced with a first spacing from adjacent apertures within the groups and the outermost aperture within each group is spaced from a closest aperture within an adjacent group at a second spacing that is greater than the first spacing.

Numbered Paragraph 20: The cabinet of Numbered Paragraph 18 or 19, wherein each of the apertures within the second of the two parallel lines are positioned to be aligned with a mid-point of a space between two adjacent apertures within the first line of the two parallel lines.

Numbered Paragraph 21: The cabinet of any one of Numbered Paragraphs 1-20, wherein a roof above each of the plurality of shelves includes one or more lights that shines light onto the shelf therebelow, wherein the controller controls the operation of each light.

Numbered Paragraph 22: The cabinet of Numbered Paragraph 21, wherein each shelf has a forward facing surface that extends proximate to the open front of the housing, wherein each forward facing surface supports a display screen, wherein the controller is configured to operate the display screen to include one or more of numbers, words, symbols, or pictures that are associated with items that are intended to be disposed within the storage volume above the respective shelf, wherein the controller is configured to operate the light upon the roof above the shelf and the display screen associated with the shelf in a constant manner such that the light and the display screen are operated collectively to identify or call attention to items that are disposed upon the respective shelf.

Numbered Paragraph 23: The cabinet of any one of Numbered Paragraphs 1-22, wherein the air flow path above the roof is formed with a decreasing height along the shelf as the shelf approaches the open front of the housing.

Numbered Paragraph 24: The cabinet of Numbered Paragraph 23, wherein the air flow path above the roof establishes a venture within the respective air flow path.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The invention claimed is:

1. A cabinet comprising:

a housing with a top wall, right and left side walls, a lower wall and a rear wall that are collectively arranged to define an internal volume therein, wherein the housing includes an open front to allow access into the internal volume;

a plurality of shelves that extend within the internal volume, wherein each of the plurality of shelves have a storage volume disposed above the respective shelf, wherein each storage volume is a part of the internal volume, wherein each of the plurality of shelves comprises a conduction heater disposed on the respective shelf that adds heat to a top surface of the respective shelf;

wherein each of the plurality of storage volumes is partially enclosed by a roof within the internal volume and above the respective storage volume, wherein the roof includes an air flow path therethrough and a plurality of apertures at an end of the roof proximate to the open front, wherein the plurality of apertures direct air flowing from the air flow path into the storage volume below the roof in an air flow direction that leaves the plurality of apertures in a substantially a downward direction;

further comprising a heating assembly that is provided in conjunction with each shelf and storage volume, wherein each heating assembly comprises a fan, a heating element, and at least one sensor, wherein the at least one sensor monitors a temperature of air flowing through the roof above the respective storage volume;

further comprising a controller, the controller is configured to control operation of the respective fan, the respective heating, and the respective heater disposed with the shelf of the plurality of shelves associated with the respective storage volume, wherein the controller selectively operates the respective conduction heater, the respective heating element, and the respective fan to control a sensed temperature of air that flows through the air flow path above the respective storage volume, wherein the roof above each of the plurality of shelves includes one or more lights that during operation shines light onto the shelf therebelow, wherein the controller controls the operation of each light, wherein each shelf has a forward facing surface that extends proximate to the open front of the housing, wherein each forward facing surface supports a display screen, wherein the controller is configured during operation to operate the display screen to include one or more of numbers, words, symbols, or pictures that are associated with items that are intended to be disposed within the storage volume above the respective shelf, wherein the controller is configured to operate the light upon the roof above the shelf and the display screen associated with the shelf such that the light and the display screen are operated collectively to identify or call attention to items that are disposed upon the respective shelf.

2. The cabinet of claim 1, wherein each shelf comprises a first standoff disposed at a front portion thereof proximate to the open front.

3. The cabinet of claim 2, wherein each first standoff comprises a plurality of apertures therein.

4. The cabinet of claim 3, wherein each of the plurality of apertures are disposed with consistent spacing between adjacent apertures.

5. The cabinet of claim 3, wherein each of the plurality of apertures extend along an upward facing surface of the standoff and transition to a surface that faces the rear wall of the housing.

6. The cabinet of claim 5, wherein each shelf has a second standoff that is proximate to or in contact with the rear wall of the housing, wherein the second standoff comprises a plurality of apertures therein, wherein the plurality of apertures in the first standoff are arranged in the same alignment as the plurality of apertures in the second standoff.

7. The cabinet of claim 6, wherein the housing further comprises a plurality of dividers that can extend within an aperture in the first standoff to an aperture within the second standoff.

8. The cabinet of claim 1, wherein the rear wall of the housing has a plurality of sets of apertures, wherein each set of apertures of the plurality of apertures is aligned above each of the respective plurality of shelves.

9. The cabinet of claim 8, wherein each heating assembly is disposed within a heating volume of a plurality of heating volumes, wherein each respective heating volume of the plurality of heating volumes is fixed to the rear wall proximate to the associated shelf such that each heating assembly encloses the respective heating element and fan of the respective heating assembly, wherein the set of apertures aligned above each respective shelf allows air flow into the respective heating assembly disposed proximate to the respective shelf.

10. The cabinet of claim 9, wherein the heating assembly comprises an angled divider disposed therein, the angled divider extends across the heating assembly above the plurality of holes and directs air entering through the heating assembly through the plurality of holes to a suction of the fan.

11. The cabinet of claim 10, wherein the heating element is disposed below the angled divider such that air entering into the heating assembly passes across or proximate to the heating element before flowing into the suction of the fan.

12. The cabinet of claim 10, wherein the discharge of the fan directs air into the airflow path within the roof.

13. The cabinet of claim 12, wherein the at least one sensor is disposed within the air flow path.

14. The cabinet of claim 1, further comprising a second sensor associated with each shelf, wherein each second sensor is disposed proximate to a top surface of the shelf.

15. The cabinet of claim 1, wherein the display screen is configured to allow for a continuously moving display.

16. The cabinet of claim 15, the display screen is configured to display the types and amounts of items that are included within the respective storage volume, and include price and/or biographic information associated with the items that are within the storage volume.

17. The cabinet of claim 1, wherein the plurality of apertures at the end of the roof are positioned along two parallel lines that are each parallel to a front face of the housing, wherein a first of the two parallel lines closest to the open front include more apertures than the apertures that form the second line further from the open front.

18. The cabinet of claim 1, wherein the plurality of apertures at the end of the roof are positioned along two parallel lines that are each parallel to a front face of the housing, wherein the apertures in the first of two parallel lines are each evenly spaced across a width between the left and right sides of the housing, and the apertures in the second of the two parallel lines are established in a plurality of groups, wherein each aperture within each group are evenly spaced with a first spacing from adjacent apertures within the groups and the outermost aperture within each group is spaced from a closest aperture within an adjacent group at a second spacing that is greater than the first spacing.

19. The cabinet of claim 18, wherein each of the apertures within the second of the two parallel lines are positioned to be aligned with a mid-point of a space between two adjacent apertures within the first line of the two parallel lines.

20. The cabinet of claim 1, wherein the air flow path above the roof is formed with a decreasing height along the shelf as the shelf approaches the open front of the housing.

21. The cabinet of claim 20, wherein the air flow path above the roof establishes a venturi within the respective air flow path.

22. A cabinet comprising:

a housing with a top wall, right and left side walls, a lower wall and a rear wall that are collectively arranged to define an internal volume therein, wherein the housing includes an open front to allow access into the internal volume;

a plurality of shelves that extend within the internal volume, wherein each of the plurality of shelves have a storage volume disposed above the respective shelf, wherein each storage volume is a part of the internal volume, wherein each of the plurality of shelves comprises a conduction heater disposed on the respective shelf that adds heat to a top surface of the respective shelf;

wherein each of the plurality of storage volumes is partially enclosed by a roof within the internal volume and above the respective storage volume, wherein the roof includes an air flow path therethrough and a plurality of apertures at an end of the roof proximate to the open front, wherein the plurality of apertures direct air flowing from the air flow path into the storage volume below the roof in an air flow direction that leaves the plurality of apertures in a substantially a downward direction;

further comprising a heating assembly that is provided in conjunction with each shelf and storage volume, wherein each heating assembly comprises a fan, a heating element, and at least one sensor, wherein the at least one sensor monitors a temperature of air flowing through the roof above the respective storage volume;

further comprising a controller, the controller is configured to control operation of the respective fan, the respective heating element, and the respective heater disposed with the shelf of the plurality of shelves associated with the respective storage volume, wherein the controller selectively operates the respective conduction heater, the respective heating element, and the respective fan to control a sensed temperature of air that flows through the air flow path above the respective storage volume, wherein the rear wall of the housing has a plurality of sets of apertures, wherein each set of apertures of the plurality of apertures is aligned above each of the respective plurality of shelves;

wherein each heating assembly is disposed within a heating volume of a plurality of heating volumes, wherein each respective heating volume of the plurality of heating volumes is fixed to the rear wall proximate to the associated shelf such that each heating assembly encloses the respective heating element and fan of the respective heating assembly, wherein the set of apertures aligned above each respective shelf allows air flow into the respective heating assembly disposed proximate to the respective shelf; and wherein the heating assembly comprises an angled divider disposed therein, the angled divider extends across the heating assembly above the plurality of holes and directs air entering through the heating assembly through the plurality of holes to a suction of the fan.

23. The cabinet of claim 22, wherein the heating element is disposed below the angled divider such that air entering into the heating assembly passes across or proximate to the heating element before flowing into the suction of the fan.

24. The cabinet of claim 22, wherein the discharge of the fan directs air into the airflow path within the roof.

25. The cabinet of claim 24, wherein the at least one sensor is disposed within the air flow path.

* * * * *